US012635757B2

(12) United States Patent
Hess

(10) Patent No.: US 12,635,757 B2
(45) Date of Patent: May 26, 2026

(54) SKI BOOT AND SKI

(71) Applicant: SUXHESS HESS BOARD + PROCESS CONSULTING, Zürich (CH)

(72) Inventor: Rudolf Hess, Zürich (CH)

(73) Assignee: SUXHESS HESS BOARD + PROCESS CONSULTING, Zurich (CH)

( * ) Notice: Subject to any disclaimer, the term of this patent is extended or adjusted under 35 U.S.C. 154(b) by 290 days.

(21) Appl. No.: 18/272,473

(22) PCT Filed: Feb. 5, 2021

(86) PCT No.: PCT/EP2021/052878

§ 371 (c)(1),
(2) Date: Jul. 14, 2023

(87) PCT Pub. No.: WO2022/167094

PCT Pub. Date: Aug. 11, 2022

(65) Prior Publication Data

US 2024/0306761 A1 Sep. 19, 2024

(51) Int. Cl.
*A43B 5/04* (2006.01)
*A63C 9/00* (2012.01)

(52) U.S. Cl.
CPC ..... *A43B 5/0452* (2013.01); *A63C 9/005* (2013.01); *A43B 5/0496* (2013.01)

(58) Field of Classification Search
CPC ..... A43B 5/0452; A43B 5/0496; A63C 9/005
See application file for complete search history.

(56) References Cited

U.S. PATENT DOCUMENTS 3,313,046 A 4/1967 Werner et al.
3,822,491 A * 7/1974 Rathmell ..... A43B 5/0468 36/117.3
4,426,796 A 1/1984 Spademan
4,565,017 A 1/1986 Ottieri
(Continued)

FOREIGN PATENT DOCUMENTS

CH 561 031 A5 4/1975
DE 43 03 969 A1 8/1994
(Continued)

OTHER PUBLICATIONS

International Search Report of PCT/EP2021/052878 dated Nov. 16, 2021 [PCT/ISA/210].

*Primary Examiner* — Brian L Swenson
(74) *Attorney, Agent, or Firm* — Sughrue Mion, PLLC

(57) ABSTRACT

A ski boot (1) includes a base frame (2) for receiving a foot of a skier; a rigid sole (3) connected to the base frame (2); a shaft (4) for receiving a lower leg part of the skier, the shaft (4) being angularly variably connected to the base frame (2); and a traction element (12). The traction element is attached to the sole (3) and/or in a toe area of the base frame (2) and extends from there to a heel area of the sole (3). In the heel area, the traction element (12) is deflected towards the shaft (4) and is then attached to the shaft (4). By inclining the shaft (4) towards a toe region, the traction element (12) can be tensioned and, in particular, traction can be exerted on the sole (3) and/or the toe region.

29 Claims, 16 Drawing Sheets

(56) References Cited

U.S. PATENT DOCUMENTS

| | | | | |
|---|---|---|---|---|
| 4,654,985 | A * | 4/1987 | Chalmers | A43B 3/0084 36/118.2 |
| 4,893,417 | A | 1/1990 | Dalla Lana | |
| 4,962,595 | A | 10/1990 | Perner | |
| 5,174,051 | A | 12/1992 | Walkhoff et al. | |
| 5,524,366 | A | 6/1996 | Caeran | |
| 2008/0209768 | A1 | 9/2008 | Trinkaus et al. | |
| 2010/0212183 | A1* | 8/2010 | Seliger | A43B 5/0405 36/2.6 |
| 2011/0083343 | A1 | 4/2011 | Holzer et al. | |
| 2014/0283414 | A1 | 9/2014 | Perizzolo et al. | |
| 2017/0368445 | A1* | 12/2017 | Mehiel | A43B 5/0401 |
| 2019/0008229 | A1 | 1/2019 | Lupinek et al. | |
| 2023/0363488 | A1* | 11/2023 | Oberhauser | A43B 5/0439 |
| 2025/0072552 | A1* | 3/2025 | Fredouille | A43B 5/0435 |

FOREIGN PATENT DOCUMENTS

| | | | |
|---|---|---|---|
| DE | 297 19 568 | U1 | 2/1998 |
| DE | 102014006178 | A1 | 10/2015 |
| EP | 0 084 788 | A1 | 8/1983 |
| EP | 0 146 502 | A1 | 6/1985 |
| EP | 0 157 240 | A1 | 10/1985 |
| EP | 0 259 896 | A1 | 3/1988 |
| EP | 0 316 540 | A1 | 5/1989 |
| EP | 0423585 | A1 | 4/1991 |
| EP | 1023847 | A2 | 8/2000 |
| EP | 3 320 796 | A1 | 5/2018 |
| FR | 2.106.728 | A5 | 5/1972 |
| FR | 2 292 442 | A1 | 6/1976 |
| FR | 2 980 957 | A3 | 4/2013 |
| JP | 3-234201 | A | 10/1991 |
| JP | 10-66603 | A | 3/1998 |

* cited by examiner

SKI BOOT AND SKI

CROSS REFERENCE TO RELATED APPLICATIONS

This Application is a national stage application of PCT/EP2021/052878 filed Feb. 5, 2021.

FIELD OF INVENTION

The present invention relates to a ski boot, a ski for use with the ski boot, and a system comprising the ski boot and ski.

BACKGROUND

In alpine skiing, especially downhill skiing, it is desirable for the skier to be able to apply pressure to various parts of the ski by shifting weight and changing leg angle. Particularly in downhill skiing, shifting pressure to the edges and front of the ski allows the skier to have more control over the behavior of the ski in turns. Applying pressure to the rear of the ski results in improved acceleration or a more comfortable ride in deep snow.

Typically, alpine skis are used in conjunction with ski boots, which are held onto the ski by a safety binding. In recent decades, ski boots have evolved from stiff leather boots to hard-shell boots. In these hard-shell boots, the skier's foot and lower leg are clamped as tightly as possible, allowing direct control of the ski boot and thus the ski by the skier.

The disadvantages of this development are that with ever harder ski boots, the comfort for the skier inevitably suffers. This may be bearable for the top athlete—for the recreational skier it is primarily painful. Particularly in the case of a foot shape that does not conform to the standard or in the case of feet of different sizes, the selection and fitting of a ski boot represents a challenge. Another disadvantage of conventional ski boots is that due to their hardness and the restricted freedom of movement of the skier, normal walking is hardly possible.

The problem is therefore to provide a ski boot that overcomes these disadvantages without sacrificing ski control and handling, and in particular even improves these properties.

SUMMARY OF THE INVENTION

This problem is solved by a ski boot according to claim 1. This ski boot comprises the following elements:

a base frame for receiving a skier's foot: In the intended use, the base frame preferably encloses the skier's foot at least partially. The base frame can be made of a soft and advantageously light material. In particular, soft means a modulus of elasticity less than 500 MPa, preferably less than 100 MPa. In particular, the base frame may comprise polypropylene foam (EPP), modified polyamide (PA), modified polypropylene (PP), modified polyethylene terephthalate (PET), polyurethane (PU) and/or modified carbon (CFRP). This increases both the comfort of the skier and the adaptability to a specific foot shape.

a rigid sole connected to the base frame: the sole can be firmly connected to the base frame or can be displaceable to a certain extent, e.g. by a maximum of 2 cm, relative to the base frame. The base frame and sole can also be formed in one piece. In particular, the sole is arranged on the ground side of the base frame in the intended use. To ensure direct power transmission from the ski boot to a ski, the sole is rigid, in particular rigid relative to the base frame. Stiff means in particular a modulus of elasticity greater than 500 MPa, preferably greater than 1000 MPa. High stiffness combined with low weight can furthermore be achieved by using a honeycomb structure in the sole. Preferably, the sole comprises polyamide, polypropylene, polyethylene, carbon fiber, silicone and/or composite. A stiff sole further ensures the usability of the ski boot with conventional safety bindings.

a shaft for receiving a lower leg part of the skier, the shaft being connected to the base frame in an angle-variable manner: preferably, the shaft is connected to the base frame via a joint. The joint may be located in an ankle region of the ski boot, advantageously on the toe side, in particular at least 2 cm, in front of the ankle region of the ski boot. The shaft preferably also comprises a rigid element.

a traction element which is attached to the sole and/or in a toe region of the base frame, runs from there to a heel region of the sole, is deflected in the heel region towards the shaft and is attached to the shaft: the traction element is guided in particular in such a way that an inclination of the shaft towards the toe region tensions the traction element and leads in particular to a traction on the sole and/or the toe region of the base frame. Thus, the skier can exert a pull on the sole and/or the toe area by tilting the lower leg forward or by going into the squat. Since the traction element counteracts further forward tilting of the lower leg, the skier thus exerts increased pressure on the sole in the toe area, i.e. the third of the sole near the toe. This improves ski control, especially when turning.

Thus, while the described ski boot is capable of providing excellent control of the ski by the skier when necessary, such as in turns, the need to build the entire ski boot from hard or stiff material is eliminated when compared to a conventional hard shell boot. Rather, apart from the sole and part of the shaft, soft and flexible material can be used, as will be described later. This allows the ski boot to be comfortably designed and flexibly adapted, especially to different foot shapes. In addition, the traction element allows increased freedom of movement when the knee is stretched through, so that walking with the ski boot is made easier.

In an advantageous embodiment, the traction element is attached to the shaft in an area remote from the sole. In particular, the half of the shaft facing away from the sole, preferably the "uppermost" quarter of the shaft, is remote from the sole. Such an attachment point increases the leverage or strengthens the effect of the traction element and thus leads to improved pressure transmission and ski control.

According to an analogous consideration, the traction element in the toe area is attached to or in the sole or base frame. This increases the pressure transfer to the toe area of the sole when the lower leg or the shaft is tilted and improves ski control.

It is particularly advantageous that the traction element is deflected a further time in the toe area of the sole and is fastened in particular in a part of the sole that is remote from the ground, i.e. the "upper" part of the sole. For this purpose, the stiff material of the sole can be pulled up to the height of the skier's toes and the traction element within the sole can also be guided up to this height and fastened there. In such a construction, an inclination of the shaft towards the toe area has the effect that the traction thus caused on the traction element pulls the toe area of the sole towards the ground or towards the ski, i.e. "downwards", in the intended use. This in turn increases the pressure exerted on the ski in the toe area and improves ski control, especially in turns.

In general, it is advantageous if the traction element is partially guided in a channel in the sole or between the sole and the base frame. This ensures that the traction element actually exerts a force on the sole and that the traction does not dissipate in the form of a deformation of the softer base frame.

In one embodiment, the traction element runs around a bend of a channel in which the traction element is guided during the deflection and/or the further deflection. Alternatively or additionally, a roller can be rotatably mounted in the bend, over which the traction element is guided. In principle, it is advantageous for the bend to have a radius of at least 1 cm, preferably at least 2 cm. This protects both the traction element and the sole material in the bend from excessive abrasion.

In an advantageous embodiment, the traction element comprises one or more bands. Examples are described below in connection with the figures. Advantageously, the traction element has low elongation, in particular a Young's modulus greater than 1000 MPa. Preferred materials for the traction element include polyester, polyamide, polypropylene, polyethylene, UHMWPE/Dyneema, aramid/Kevlar/Twaron, LCP/Technora, steel fibers, elastic fibers and/or carbon fibers.

In a further embodiment, the traction element comprises a mechanical tension element and/or an electromechanical tension element, which is designed to adjust a length and/or a tension of the traction element. The adjustment can be done in steps, e.g. by engaging, by a tensioning buckle or steplessly, e.g. by turning a screw in a thread. In the case of an electromechanical tension element, the ski boot additionally comprises a power source, e.g. a battery, which is electrically connected to the electromechanical tension element for supplying the latter with power. Advantageously, the ski boot further comprises a sensor for measuring the length or tension of the tension element and a controller arranged to control the tension element in response to a signal from the sensor. This allows the tension element to be automatically adjusted, for example, to a defined length or tension for a particular skier or a particular skiing situation.

Advantageously, the mechanical tension element and/or the electromechanical tension element is designed to loosen or release the traction element (12) for a walking mode of the ski boot. In particular, the shaft shall be pivotable in the walking mode by at least 4 degrees, preferably at least 8 degrees, relative to the base frame. This enables ergonomic walking with the ski boots.

In one embodiment, the shaft comprises a rigid element on the heel side to which the traction element is attached. The rigid element can extend, for example, on the heel side, i.e. on the back of the lower leg, to the end of the shaft remote from the heel ("upper" end of the shaft). Preferably, the rigid element is a hollow element, in particular a hollow profile made of aluminum, through which the traction element is passed. Such a heel-side stiff element allows further parts of the shaft, which run around the lower leg ("forward"), for example, to be made of soft material. This in turn increases the comfort and adaptability of the ski boot.

Advantageously, the base frame, sole and/or shaft comprises at least one of the following materials: plastic, carbon, polyamide, polyester, polypropylene, polyurethane, spandex, PET, aramid, UHMWPE, aluminum, titanium, steel.

Furthermore, it is advantageous that the ski boot comprises a locking device for locking the shaft at a definable angle to the base frame. In particular, the locking device can be designed to prevent an increase in the angle between the shaft and the base frame. The locking may be achieved, for example, by a second traction element, such as a strap or wire, which extends across the angle between the shaft and the base frame and may be locked at a defined length. In another embodiment, the locking device comprises fixing elements, such as steel or plastic screws, spacer-holding screws, or steel, aluminum, carbon, or plastic fixing parts. The locking device can be loosened for walking and increases the shaft angle for easier walking.

In an advantageous embodiment, the ski boot comprises an upper structure that is insertable into the base frame and the shaft and that rests against the skier's foot during intended use. Advantageously, the upper structure comprises a closure for closing and/or adjusting the upper structure to the skier's foot. This may comprise, for example, a zip fastener, a hook and loop fastener, a hook and loop fastener, laces and/or press studs. Furthermore, it is desirable that the upper structure has at least one of the following properties: waterproof, moisture-wicking, wind-repellent, flexible, warming. Thus, the described upper structure primarily serves to provide comfort and adaptability of the ski boot to the skier. The comfort can be further increased by the upper structure additionally comprising a heating element, in particular a battery-operated heating element.

In an advantageous embodiment, the ski boot additionally comprises at least one holding element, the ends of which are attached to the base frame and/or the shaft and which is set up to hold the base frame and/or the shaft on the skier's foot. The at least one holding element thus ensures that the foot is firmly seated in the ski boot and that the ski boot follows the movements of the foot or lower leg accordingly.

Advantageously, the at least one holding element comprises a mechanical adjustment element and/or an electromechanical adjustment element that is variable in length in order to hold the base frame or the shaft on the skier's foot in a non-slip manner. The adjustment element thus enables the ski boot to be adapted to different feet, as well as easy entry into and exit from the ski boot. In a particularly advantageous embodiment, the mechanical adjustment element and/or the electromechanical adjustment element comprise a cable that can be adjusted via a twist lock.

Analogous to the tension element described above, the electromechanical adjustment element can also be set up for automatic or remote-controlled adjustment of the at least one holding element. For this purpose, the ski boot can in turn comprise a sensor for measuring the length or the tension of the adjustment element, as well as a control unit that is set up to control the adjustment element as a function of a measured value of the sensor. Such a control unit is particularly useful for adapting the ski boot to changing slope conditions, a changed foot circumference or a changed hardness of the ski boot, e.g. as a result of temperature changes.

Advantageously, the at least one holding element comprises at least one of the following bands:

- a forefoot strap attached to the base frame in a forefoot region of the ski boot, the forefoot strap being adapted in particular to hold the base frame against a forefoot of the skier;
- an ankle strap attached to the base frame in an ankle region of the ski boot, the ankle strap being particularly adapted to hold the heel region of the ski boot to a heel of the skier;

a lower leg strap attached to the shaft in a lower leg region of the ski boot, the strap being particularly adapted to hold the shaft against a lower leg of the skier.

Each of these straps contributes to a secure fit of the ski boot on the skier's foot without compromising comfort.

For a particularly good fit of the ski boot or to stabilize the skier's ankle, the ski boot can additionally comprise an ankle bandage. Such an ankle bandage encloses the skier's ankle in the intended use and can be inserted into the shaft and the base frame, if necessary together with the skier's foot. In the intended use, the ankle bandage is held by the at least one holding element, in particular by the ankle strap. The ankle bandage may comprise a padded material. Further, the ankle bandage may comprise a second heating element.

As described further above, the ski boot may include a control unit. This can additionally be equipped with a radio receiver which is set up to receive a radio signal from an external transmitter, in particular from a cell phone or from a ski pole with Bluetooth transmitter. The controller is then adapted to control the tension or length of at least one of the following elements: the tension element, the locking device, the electromechanical tension element, the at least one strap, the electromechanical adjustment element. This allows a remote controlled adjustment of the ski boot to the foot, to changing environmental conditions or to a desired ride characteristic. Additionally, the control system may be arranged to control a heating power of the heating element or the second heating element, if present. In general, a remote or automatic control avoids the skier having to bend down to the ski boot and handle it. This in turn increases the comfort for the skier.

In an advantageous embodiment, the ski boot additionally comprises a toothing on the traction element, which is accessible from an outer side of the sole. In particular, the toothing is designed in such a way that, in the intended use, it is engaged with a ski toothing as a counterpart, which is attached to a ski. At the same time, the connection between the toothing and the ski toothing must be designed to be detachable. In particular, the toothing is designed to be compatible with conventional safety bindings, i.e. the connection between the toothing and the ski toothing disengages when the safety binding releases and releases the ski boot.

Another aspect of the invention relates to a ski comprising a ski traction element. The ski traction element extends from a binding region of the ski within the ski into a ski front portion and/or into a ski rear portion, where it is attached. Further, the ski traction element has a ski toothing that is externally accessible in the binding region and is adapted to be engaged with the toothing of the ski boot described above. Via the ski toothing and the ski traction element, a pull caused by the skier on the traction element in the ski boot is transmitted to the ski. In the ski, the ski traction element is designed, i.e. guided and fastened, in particular in such a way that it leads to a stiffening of the ski, which in turn improves ski control by the skier and cornering behavior. The same materials can be used for the ski traction element as for the traction element in the ski boot.

Advantageously, the ski traction element runs in a part of the ski that is close to the ground, i.e. for the larger part in the half of the ski cross-section that is close to the ground. For example, the ski traction element may be guided between a base and a core of the ski.

In one embodiment, the ski traction element is attached to the front part of the ski, in particular in a shovel of the ski. Preferably, the ski element is attached in the third of the shovel close to the ground. This prevents the shovel from being bent away from the ground when the ski traction element is pulled, but at the same time enables effective stiffening of the ski when the ski traction element is pulled. In the intended use with the ski boot, the ski traction element thus causes a pull on the front part of the ski when the shaft is inclined towards the toe area and, in particular, stiffens the front part of the ski.

Alternatively or additionally, the ski traction element can be fixed in the rear part of the ski. In this case, the ski comprises a deflection for the ski element in the ski, whereby the ski traction element is guided into the ski rear part via the deflection. In intended use with the ski boot, the ski traction element causes a pull on the ski rear part when the shaft is inclined towards the toe area and, in particular, stiffens the ski rear part.

Another aspect of the invention relates to a system comprising a ski boot, in particular the ski boot having teeth on the traction element, a ski as described above, and a ski binding attached to the ski and adapted to retain the ski boot in the intended use.

BRIEF DESCRIPTION OF THE DRAWINGS

Further embodiments, advantages and applications of the invention result from the dependent claims and from the following description regarding the figures. Thereby showing:

DETAILED DESCRIPTION

Figure 1:
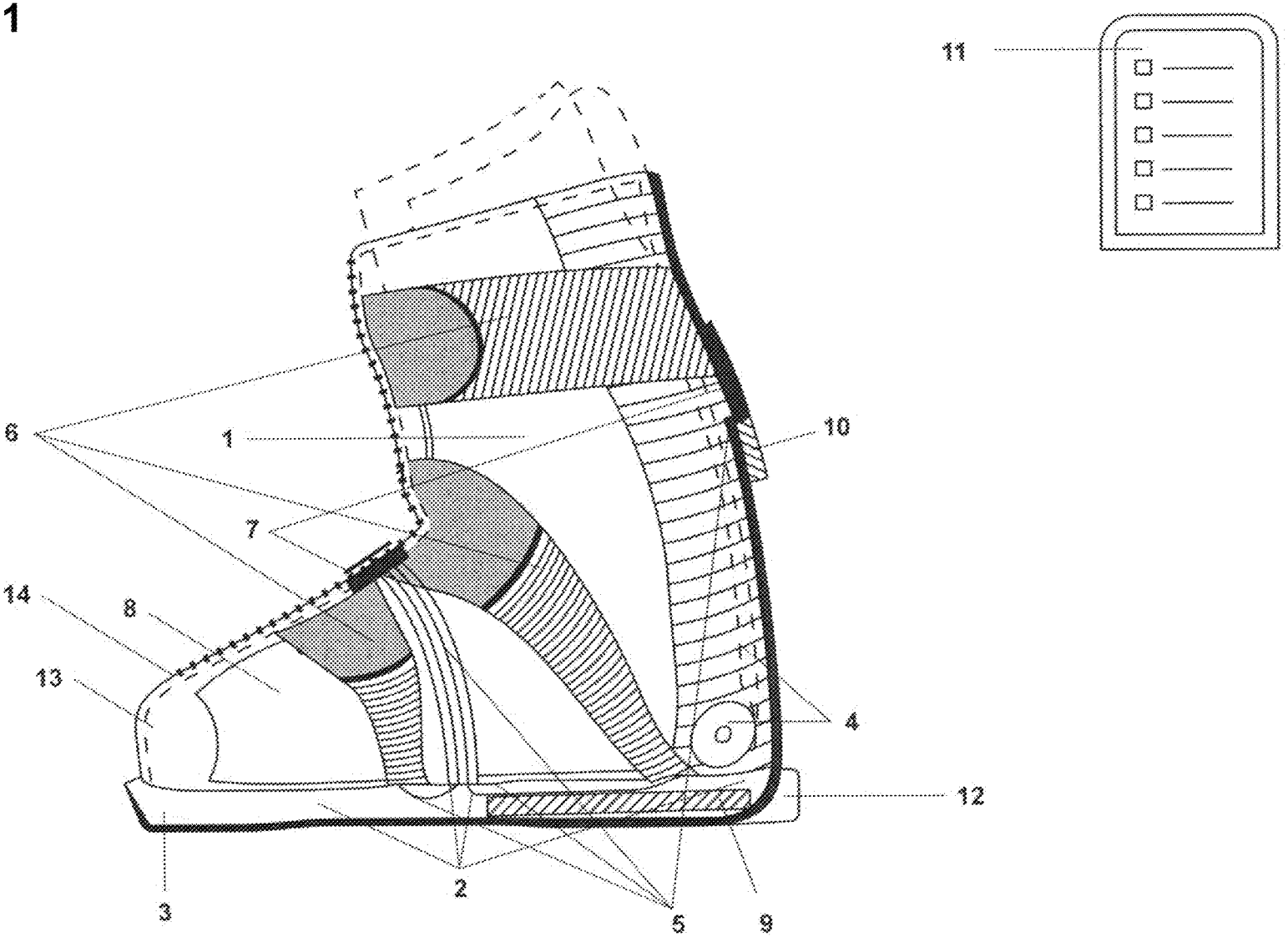
FIGS. 1, 3 and 4 each show a ski boot according to an embodiment of the invention.

FIG. 1 shows a ski boot 1 with a base frame 2 and a shaft 4 whose angle to the sole 3 can be changed. Mechanical parts 5 are located on the base frame 2 and a number of straps 6 are arranged on these as holding elements and are tensioned by mechanical elements 5 and supplementary electromechanical elements 7 as adjusting elements. The straps are underlaid with an ankle bandage 8. A battery 9 is located in the sole 3 and a control 10 of the electromechanical elements 7 is performed by an app in a mobile phone 11.

A low-stretch band 12 is arranged on the shaft, which increases the pressure, by tilting and bending the shaft 4 forward, i.e. towards the toe area, on the sole 3.

The shoe upper structure 13 is made of a waterproof, warming, moisture-wicking, cut-resistant, aesthetically pleasing composite material. The shoe upper 13 is provided with a zipper 14 for closing.

Figure 2:
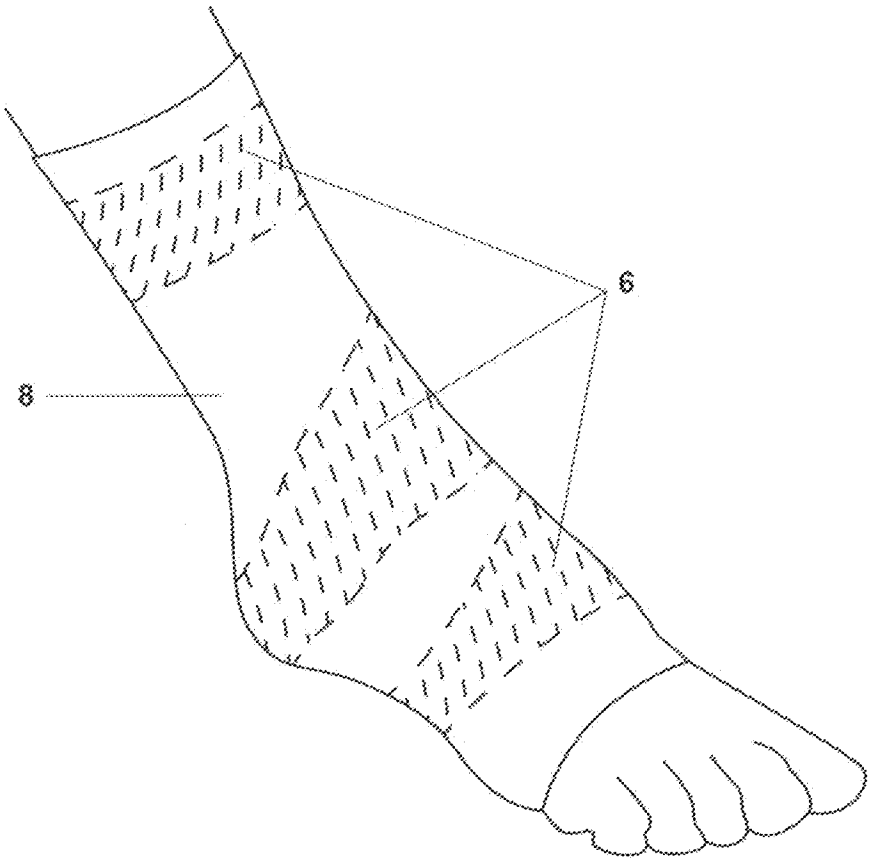
FIG. 2 an ankle bandage according to an embodiment of the invention.

FIG. 2 shows an ankle bandage 8 which, similar to a sock structure, is made of elastic, partially elastic, stiff, non-slip, moisture-wicking, warming and padded materials placed under the straps 6 which act as holding elements.

Figure 3:
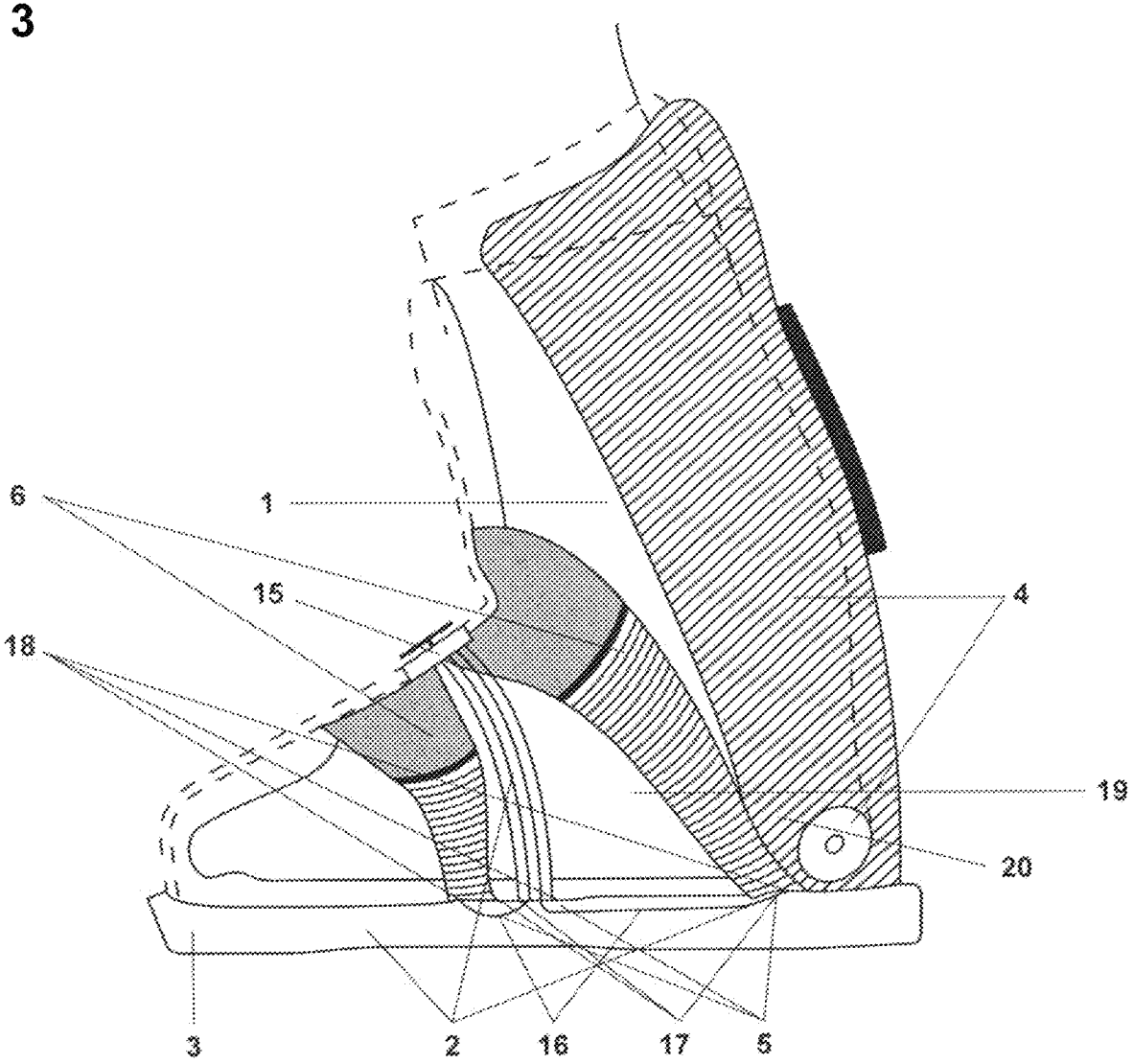

FIG. 3 shows a tensioning mechanism 15 of two straps 6 of different widths, in two parts and made of different materials, which are arranged anatomically to the foot and are tensioned with mechanical elements 5. A tensioning mechanism 15 attached to the base frame 2 of the ski boot 1, pulls mechanical parts 5, consisting of high-strength ropes 17, which are attached to the straps 6 over mechanical elements, such as rollers, sliding elements 18, thereby creating a tension on the different straps 6. These hold as holding elements the foot 19 in the ski boot 1, in particular the heel area 20 locked and on the sole 3 and in the shaft 4.

Figure 4:
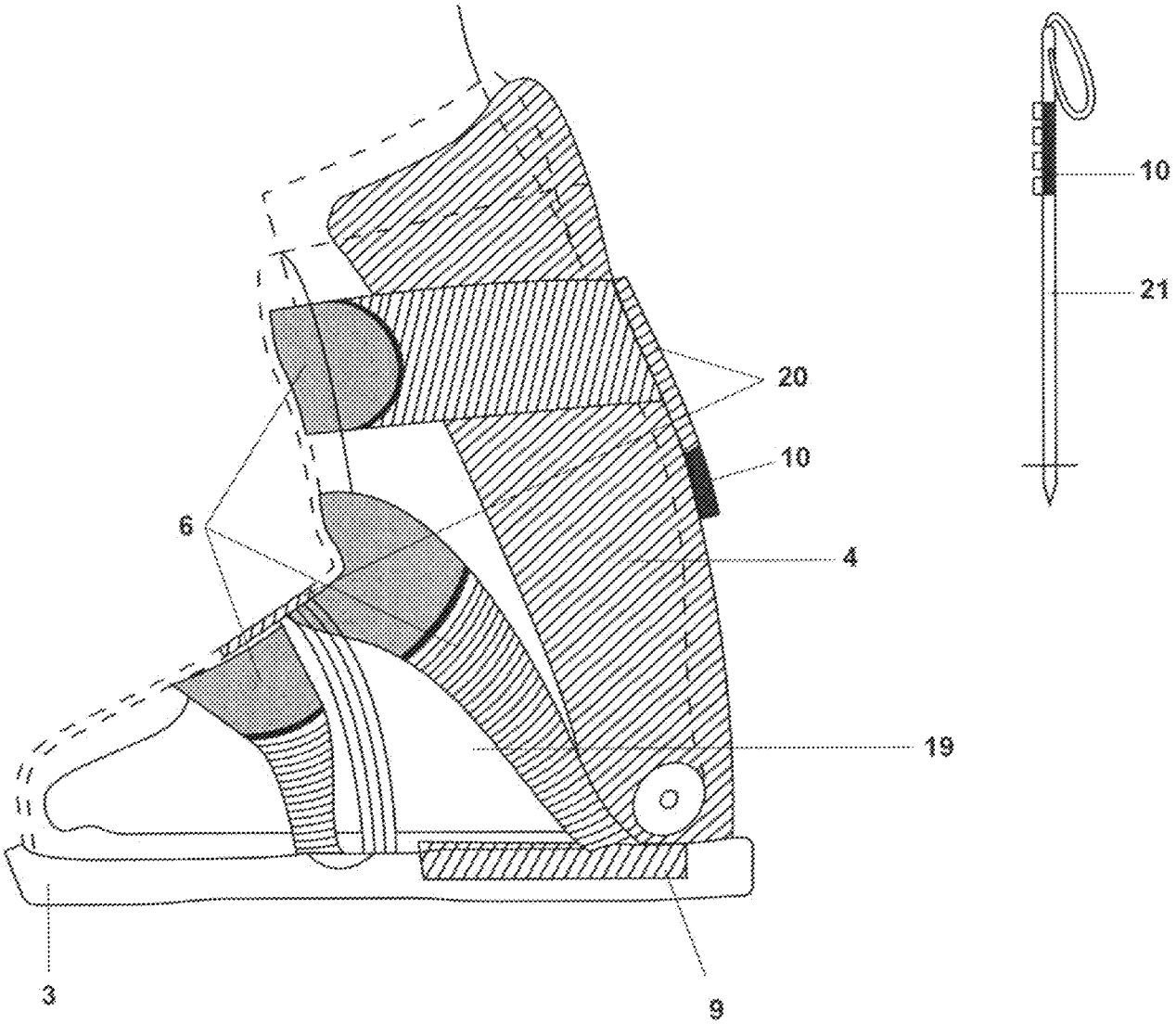

FIG. 4 shows several multi-part straps 6 (holding elements) in different widths and made of different materials, which are arranged in such a way that a high degree of accuracy of fit is achieved even with anatomically different feet 19. In order that a precisely fitting and desired tension of the straps 6 is created, micromotors 20 are controlled by an electronic control unit 10 and the straps 6 are tensioned as a result. The battery 9 is located in the sole 3. The control unit 10 is located in this case on the shaft 4 and in the ski pole 21.

Figure 5:
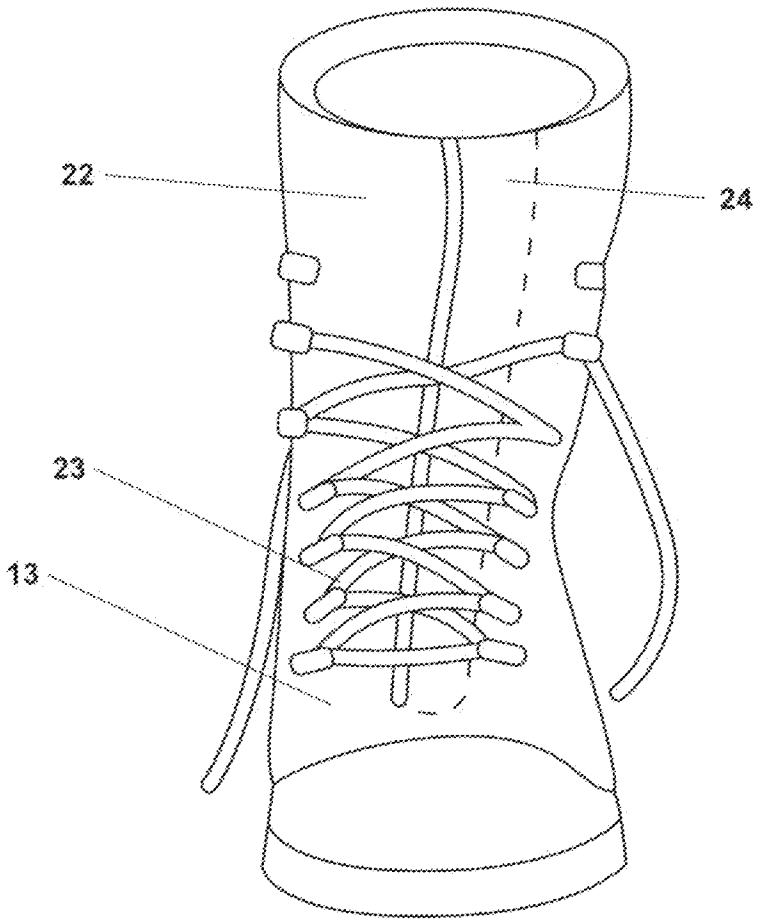
FIGS. 5 and 6, respectively, an upper structure for the ski boot according to an embodiment of the invention.

FIG. 5 shows a shoe upper 13 made of a composite of waterproof, windproof, soft, insulating, warming, cut-resistant, moisture-wicking, padded materials. The outermost layer of the upper is made of aesthetically pleasing material, e.g., leather 22. The closure is made of laces 23 and a slightly adhesive overlapping material 24.

Figure 6:
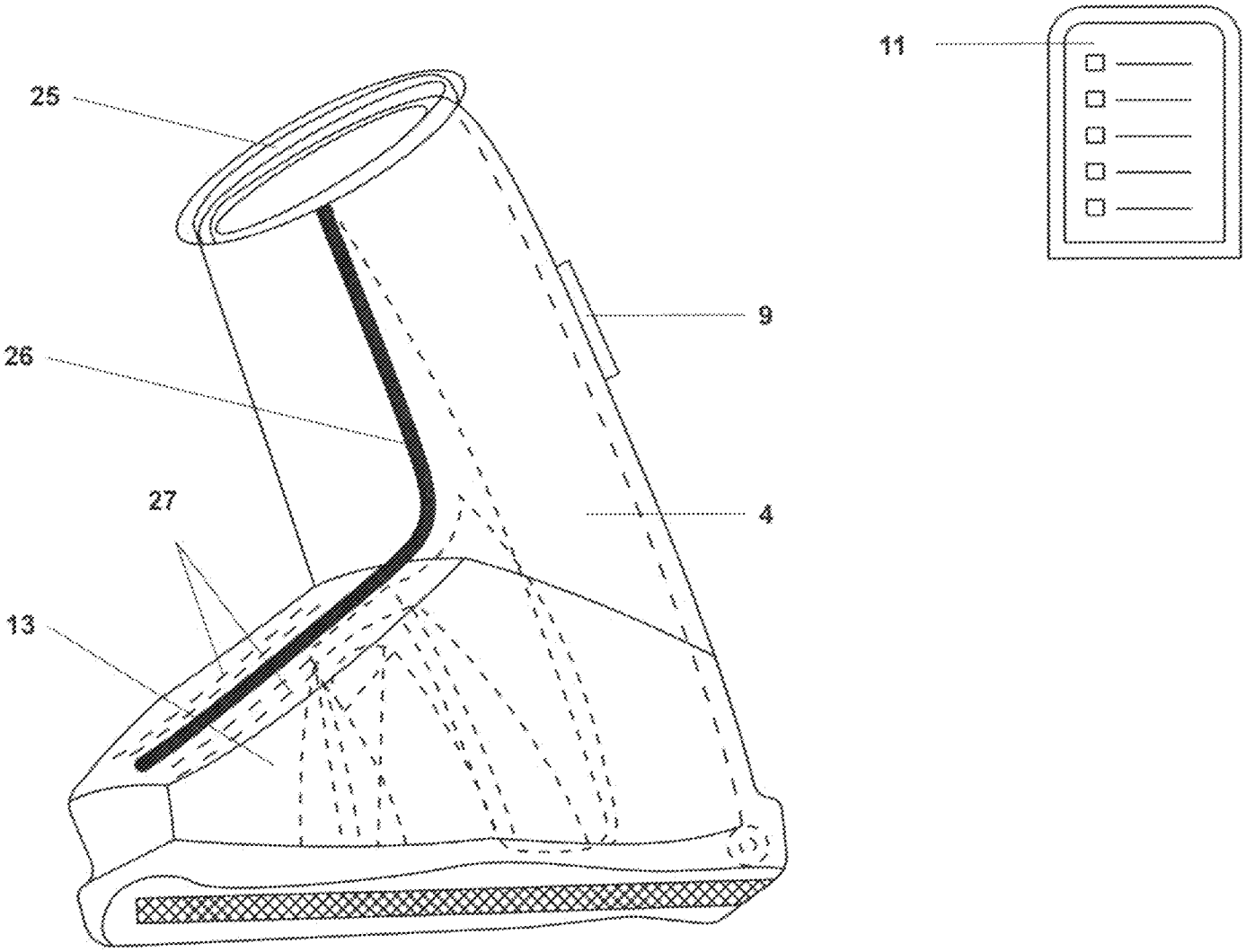

FIG. 6 shows a multi-layer shoe upper 13 made of a composite of materials 25 which transport moisture away from the foot to the outside, form an insulating layer, have a heatable layer and an outer layer which serves aesthetic purposes. The shoe upper is closed with a zipper 26. For additional heat, heat-generating elements 27 have been introduced into a layer in the upper structure, which are heatable by means of battery 9 located on the upper 4. The heat control 27 is done by means of an app in a mobile phone 11.

Figure 7:
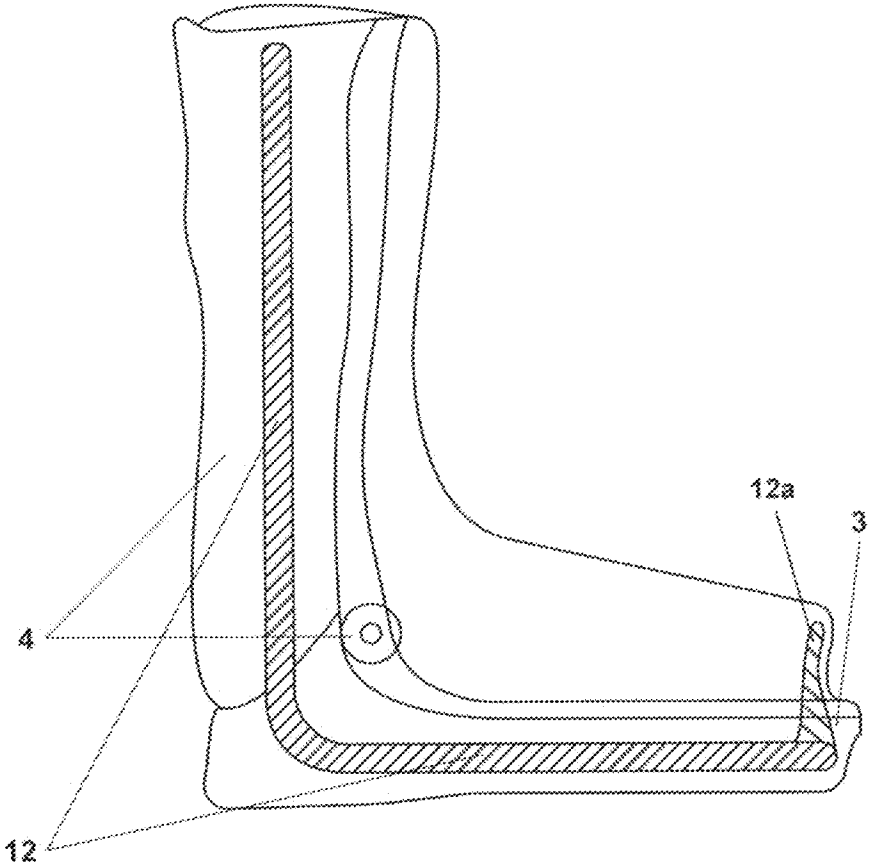
FIGS. 7, 8, 9 and 10 each show a schematic section through a ski boot with traction element according to an embodiment of the invention.

FIG. 7 shows an increase in pressure on the sole 3 by means of a two-part band 12 as a traction element in a varying width, made of stretch-free materials, in which one part is arranged on the shaft 4 and one part in the sole 3 and is tensioned with a shaft inclination 4. Advantageously, the band 12 is deflected a further time in the toe region of the shoe, thus comprising a further part 12*a* which is fastened in the toe region remote from the sole ("above"). The portion 12*a* of the band 12 may be secured in the sole 3 or in the base frame. In general, the fastening of the band 12 or 12*a* in the toe region remote from the sole causes an increase in the pressure on the sole in the toe region when the shaft 4 is tilted towards the toe region (towards the "front").

Figure 8:
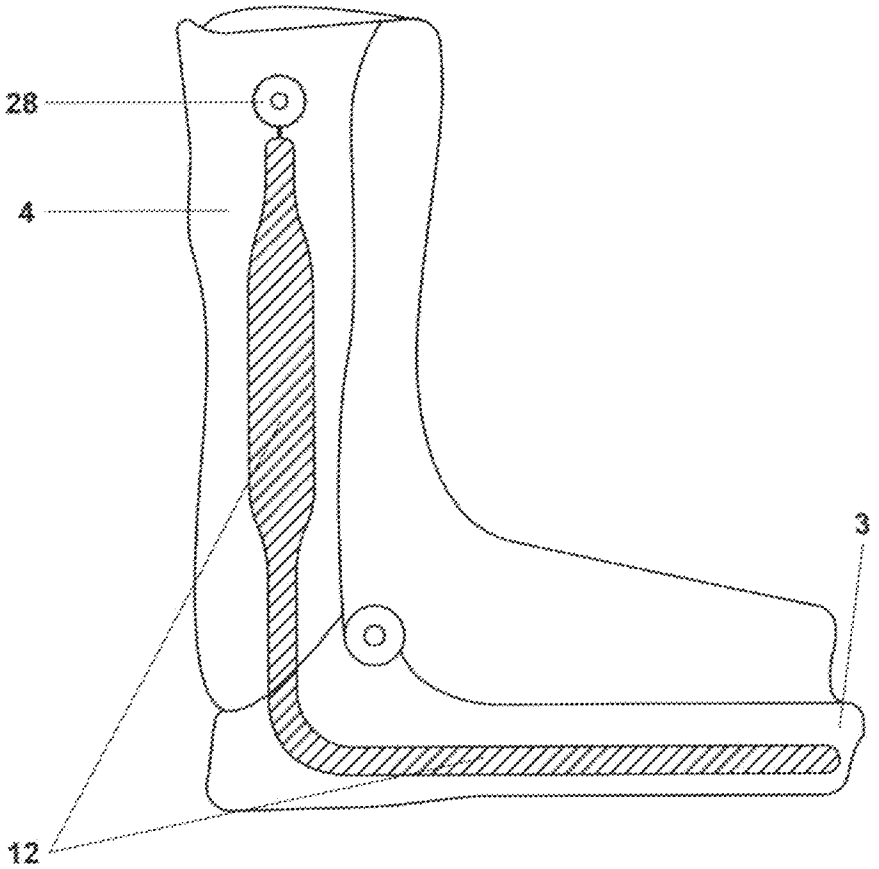

FIG. 8 shows a mechanical tensioning mechanism 28 of multi-piece bands 12 (traction element) in varying widths, made of non-stretch materials, in which one part each is arranged on the shaft 4 and on the sole 3 and is tensioned with a mechanical element 28.

Figure 9:
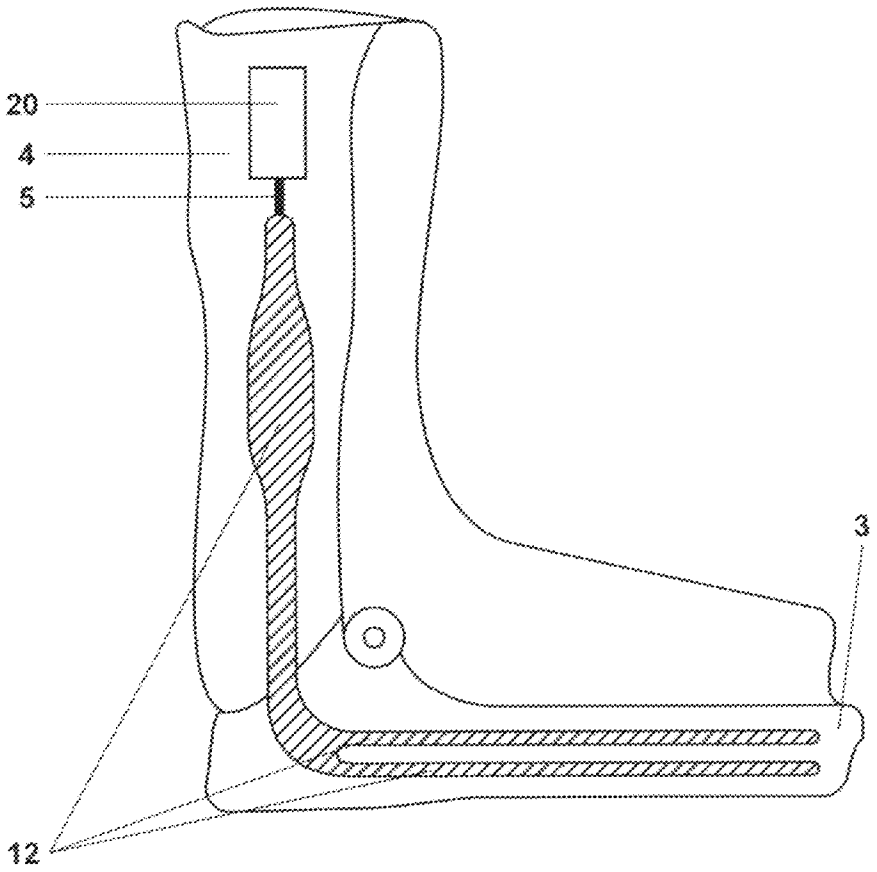

FIG. 9 shows an electromechanical tensioning mechanism 20 of one or more bands (traction element) arranged on the shaft 4 and in the sole 3 in such a way that the pressure on the shoe sole, binding and binding plate part is increased by mechanical elements and a micromotor 20, e.g. electronically controlled.

Figure 10:
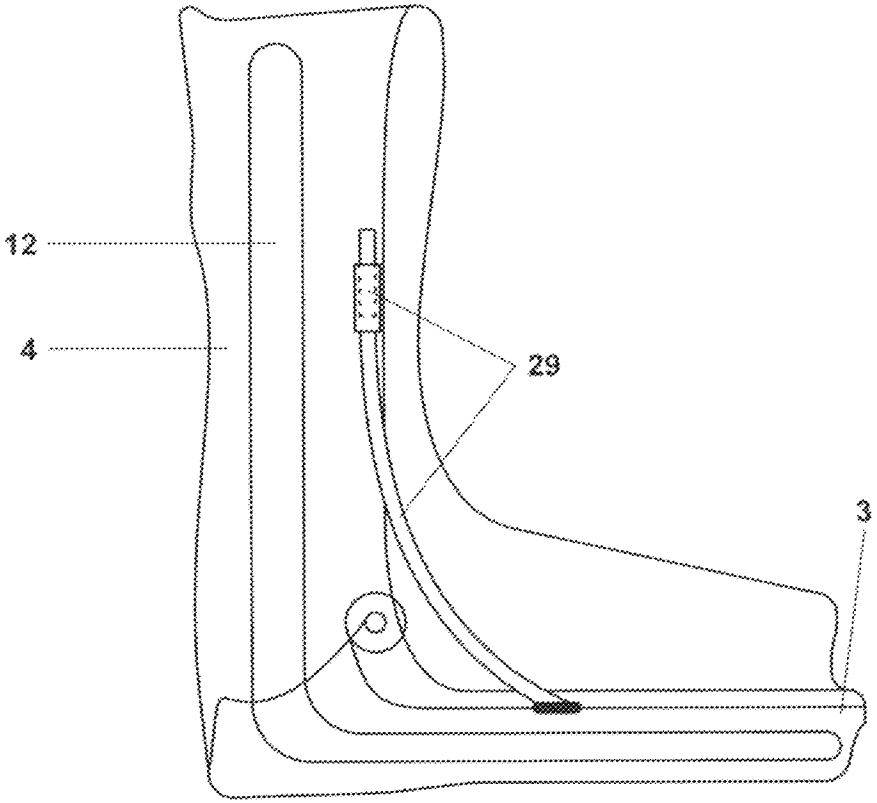

FIG. 10 shows a shaft 4 that has a locking device 29 of the shaft 4 that can be changed in the angle to the sole 3 and can be adjusted to a changed leg bending position depending on the riding comfort and riding style, which results in a constant pressure on the sole 3 by means of bands 12.

Figure 11:
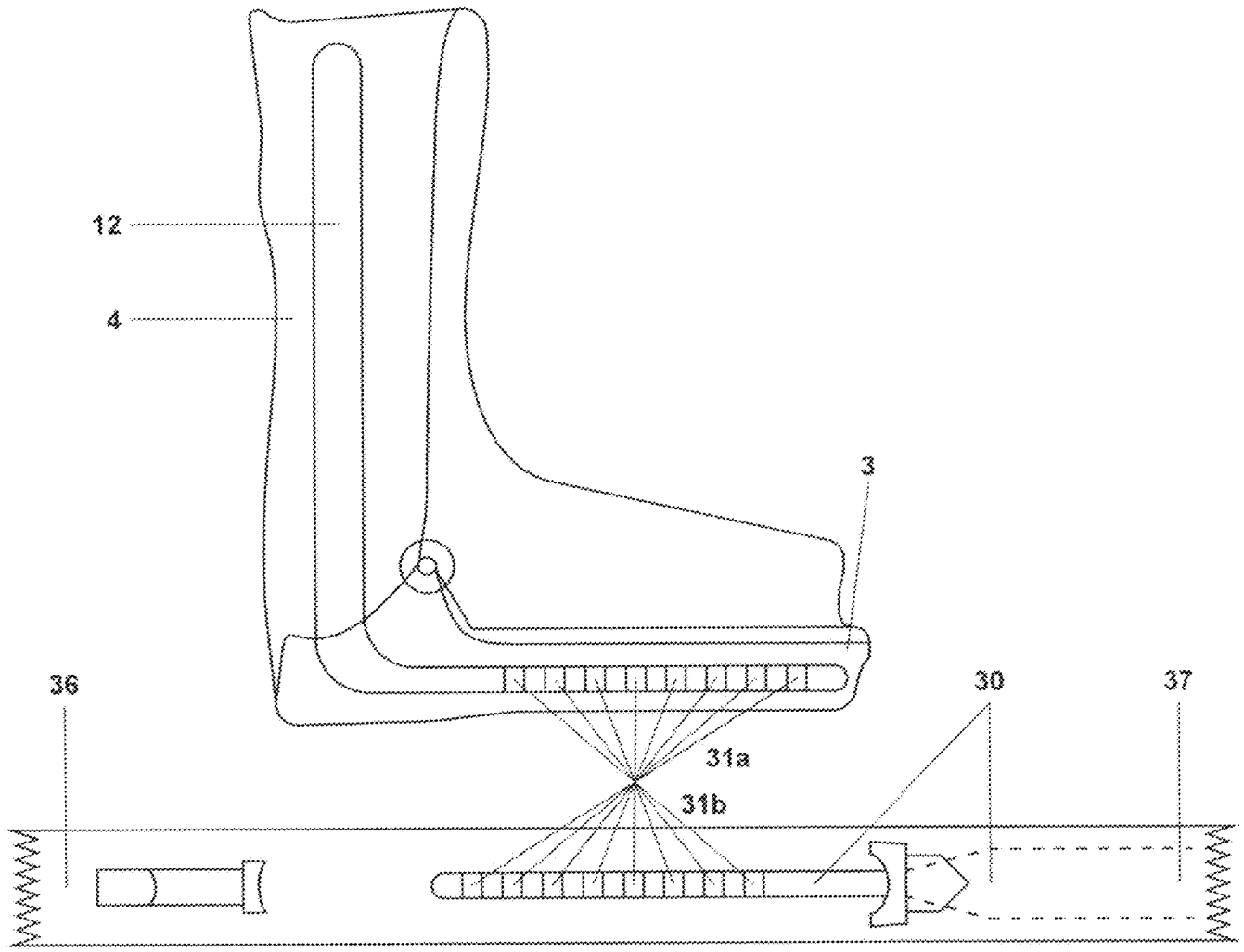
FIGS. 11 and 12 each a functional drawing of a system with ski boot and ski according to an embodiment of the invention.

FIG. 11 shows several multi-piece bands 12 arranged as a traction element on the shaft 4 and in the sole 3 in such a way that by bending the shaft 4 forward, the several bands 12 are more strongly tensioned and the pressure on the ski front part 37 is increased by a band toothing 31*a* and by arranging a band as a ski traction element 30 with ski toothing 31*b* in the ski 36.

Figure 12:
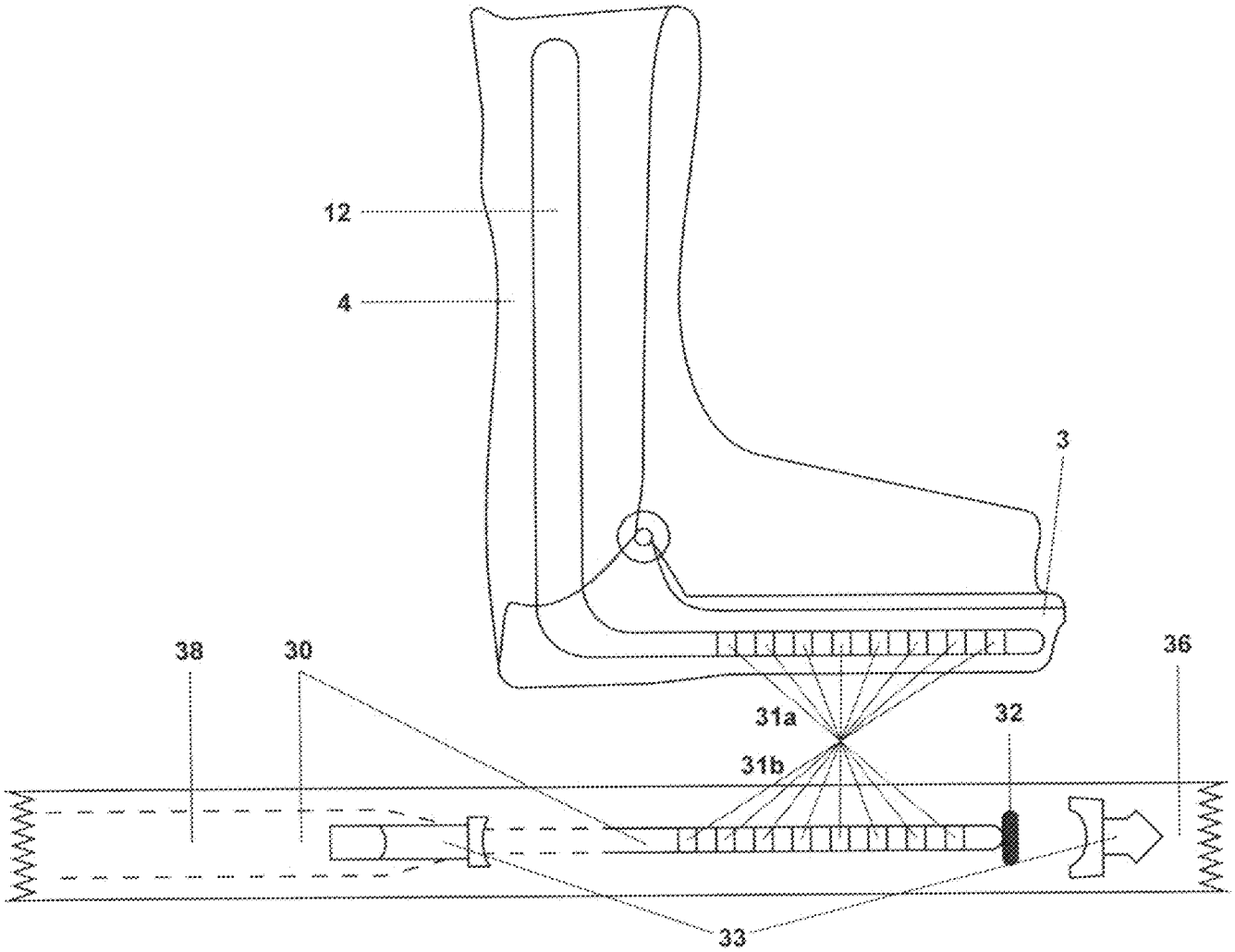

FIG. 12 shows several multi-part bands 12 (traction element) arranged on the shaft 4 and in the sole 3 in such a way that by bending the shaft 4 forward, the several bands 12 are more strongly tensioned and the pressure on the rear part 38 of the ski is increased by a strap toothing 31*a* and arranging a strap 30 as a ski traction element with toothing 31*b* and deflection 32 in the ski 36.

Figure 13:
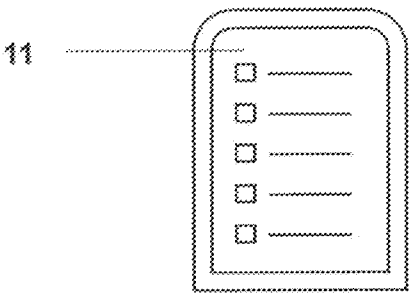
FIG. 13 a schematic drawing of holding elements according to an embodiment of the invention.
Figure 13:
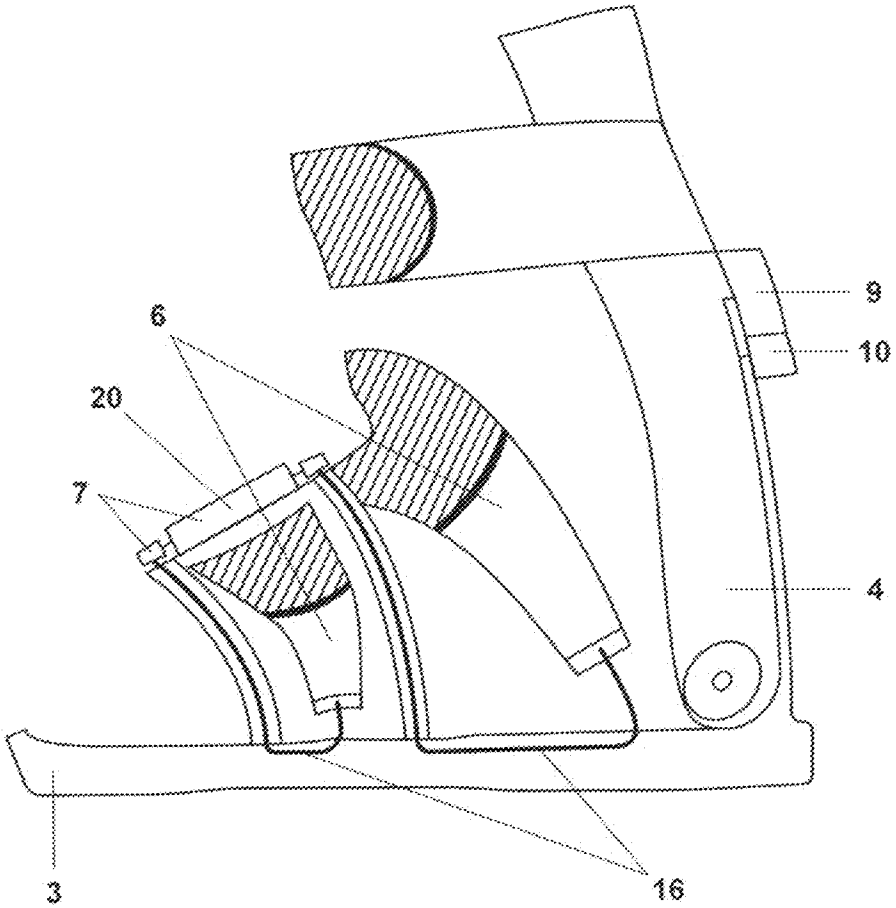

FIG. 13 shows that several bands 6 are arranged as holding elements in different widths and made of different materials, connected with ropes 16 and tensioned by electromechanical parts 7 in the form of a micromotor 20 powered by a battery 9 on the shaft 4 and a control 10 by means of a mobile phone app 11.

Figure 14:
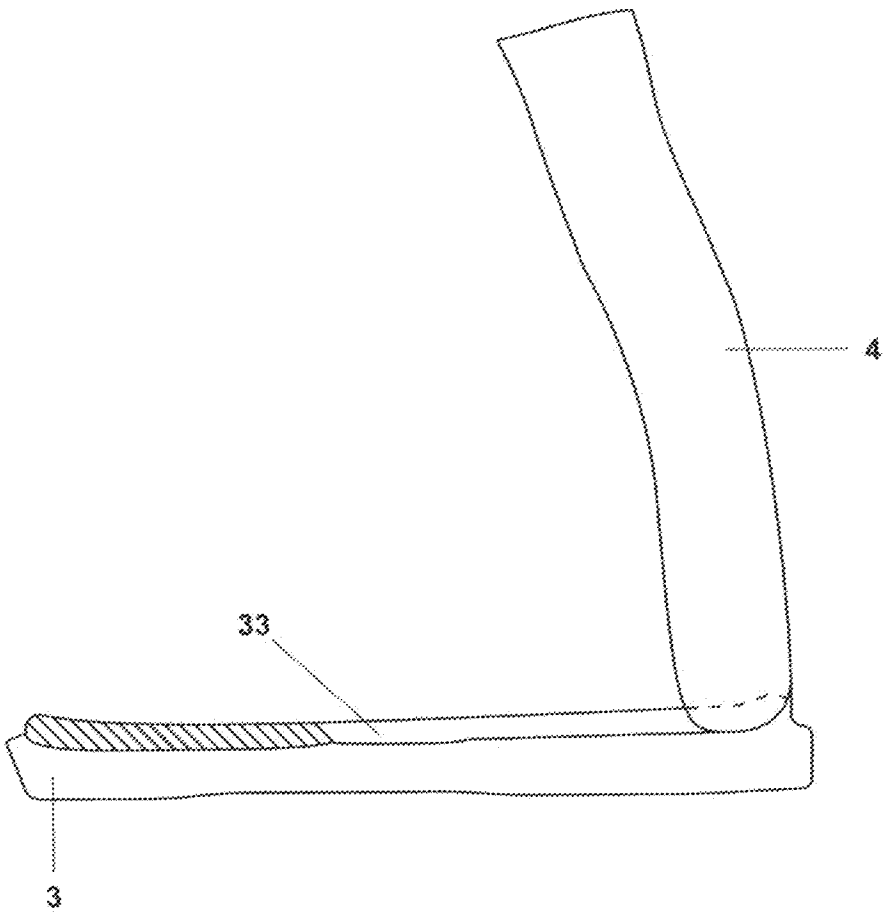
FIGS. 14 and 15 each a schematic drawing showing an insole and a reinforcing insole, respectively, according to an embodiment of the invention.

FIG. 14 shows an insole 33 that can achieve performance-enhancing, optimal pressure distribution on the sole 3, similar to a modern running shoe.

Figure 15:
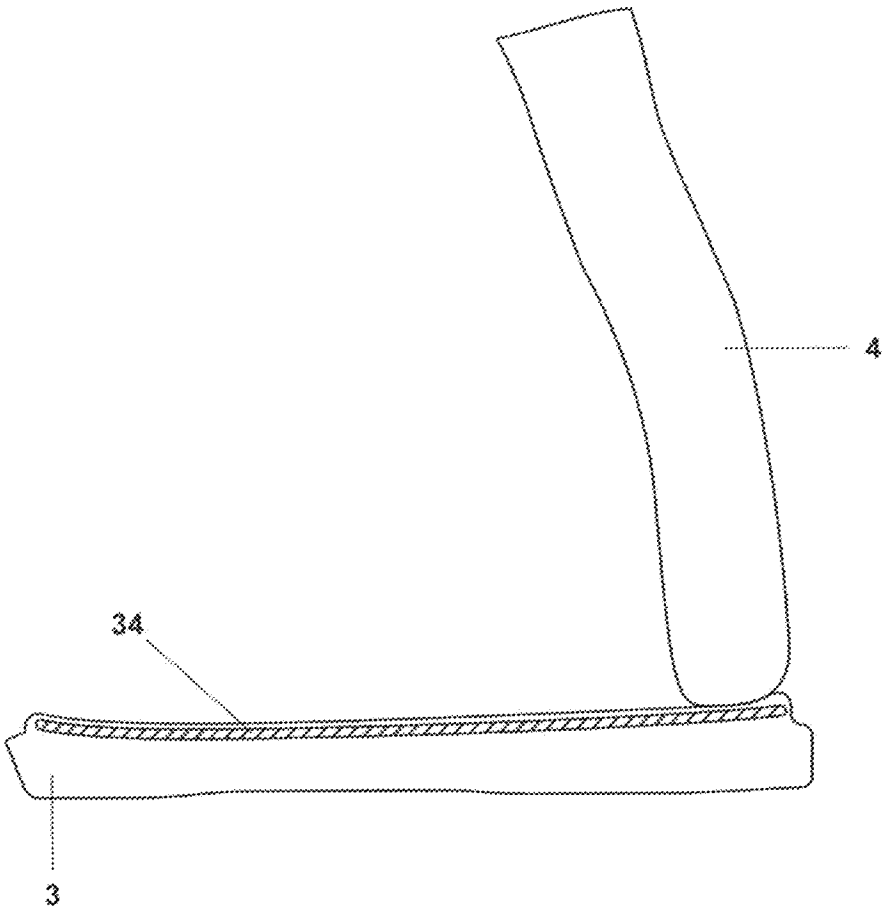

FIG. 15 shows an inner reinforcing insert 34 arranged in the flexible sole 3 in such a way as to prevent downward deflection of the flexible sole 3.

Figure 16:
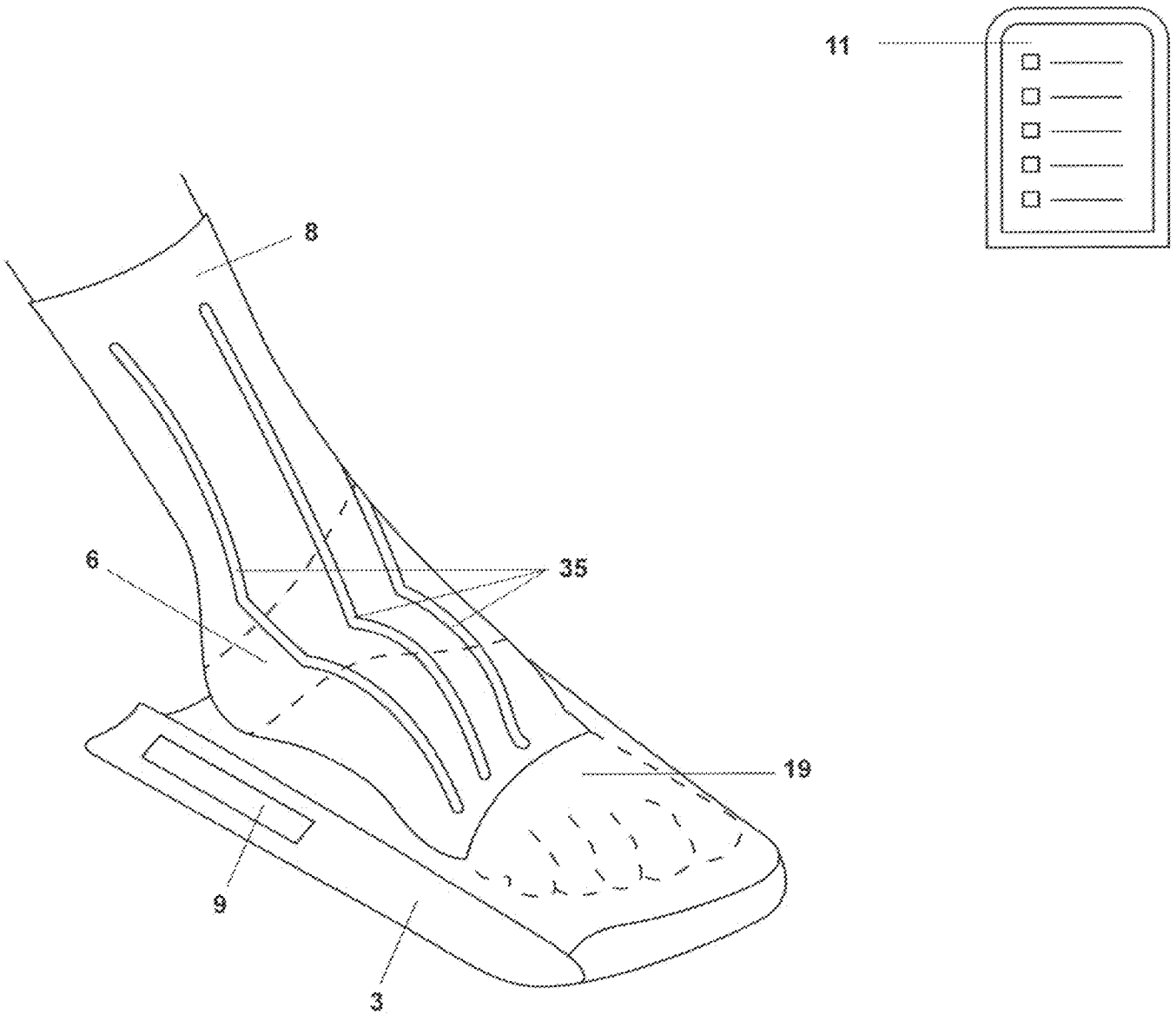
FIG. 16 an ankle bandage with heating elements according to an embodiment of the invention.

FIG. 16 shows an ankle bandage 8 which is similar to a sock structure made of, for example, elastic, partially elastic, stiff, slip-friendly, non-slip, moisture-transporting, warming and/or padded materials between the foot and the bands. Heating elements 35 are also incorporated into the ankle bandage 8. The heating elements 35 can be controlled by the mobile phone app 11.

In general, therefore, from the point of view of the inventor, embodiments of the present invention can be used to create a ski boot which is configured in such a way that

- a high level of comfort is created, which nevertheless provides the necessary hold of the foot in the ski boot and a desired pressure on the sole, the binding, the binding plate and the ski, and the comfort of the foot lock in the ski boot and the ease of entry is significantly increased.
- a pressure drop on the foot does not occur even after prolonged wear and heating of the ski boot material (traction element and holding element).
- cold feet do not occur and the pressure generation on the foot in the ski boot is the same for both feet even with different anatomy or size (flexibly adjustable upper structure and traction element).
- the generation of pressure on the foot and the hold in the ski boot, including the heel, can be done easily and without great effort (holding element, in particular ankle strap, and traction element).
- the materials and the ski boot construction are chosen to allow easy entry.
- the different foot anatomy and the wearing comfort, in particular also in cold weather, is taken into account.
- the pressure generation on the foot and thus the hold in the ski boot, the hold of the heel in position, can be made comfortable.
- the necessary and desired pressure can be varied on the binding, the binding plate area, the ski, and thus take place at any time as desired and reinforced.

the ski boot has a sole that allows some rolling when walking, also works properly with the usual safety bindings and can create a desired pressure on the ski.

the ski boot has a basic frame consisting of a sole and a shaft, an upper structure and tensioning straps as holding elements and mechanical and/or electromechanical tensioning elements with control, so that user-friendly pressure on the foot and locking of the foot can be produced, even in the case of anatomical differences.

the base frame, the sole and the shaft are made of materials that can withstand high pressure, are light and do not permanently deform even under high pressure or tensile load, heat or cold.

the materials of the sole also allow the use of the usual safety bindings and plates. The sole is shaped or made of materials that also allows some rolling when walking.

the shaft is connected to the sole in such a way that the angle to the sole can be easily changed or locked. A bending stiffness of the shaft, transmitting the pressure of the leg when bent or locked at an angle forward, to the sole, binding plate and ski.

an amplification of the pressure can be increased by tensioning one or more tapes as a traction element.

the shaft is provided with anatomically shaped padding.

both the one or more straps on the socket and on the sole (holding elements), and the mechanical or electromechanical parts can be fitted well.

the materials used of the base frame, the sole, the shaft, preferably include at least one of plastics, composite plastics, molded, injected, mechanically processed, such as carbon, polyamide, polyester, polypropylene, polyurethane, elastane, PET, aramid, UHMWPE, or materials such as aluminum, titanium, steel.

the upper structure consists of one or more e.g. waterproof, moisture-transporting, wind-repellent, hard or soft, flexible or stiff, insulating, warming, additionally heating materials, which have no influence on the pressure to be generated on the foot and its arrest within the ski boot or the ski, but serve exclusively the ski boot wearing comfort.

the upper structure can be closed with a zipper, Velcro or hook fastening, overlapping with slightly adhesive material, laces and/or snaps.

the locking of the foot and the heel in the ski boot, on the sole and against the shaft, is generated by an adapted pressure, by means of at least one or more bands as holding elements. The straps can have different widths and different materials and can be single or multi-piece.

the pressure on the foot and the lower leg area tibia/fibula inside the ski boot is carried out by anatomically adapted and in the execution quality and the materials differently arranged bands, which are tightened depending on the foot ergonomics and the desired pressure and are varied in width, length, and can be single or multi-piece.

the pressure on the ski boot sole, as well as on the ski, in addition to the sole area and the foot pressure, is effected by arrangement of bands, whereby at least one of the bands is arranged as a traction element in particular for this pressure generation. This band has a tensioning pressure/tensioning behavior independent of the foot locking bands, which is mainly generated by the shaft.

the tensioning of the bands (traction element and/or holding elements) is carried out by various mechanical elements such as buckles, shafts, wheels, drum wheels, flexible shafts, tensioning wheels, cords, ropes, and/or by electromechanical elements such as batteries, micromotors and their electronic control.

the straps/bands (holding elements) to lock the foot in the ski boot, to keep the heel in position, also to hold it on the sole and on the shaft, are arranged in such a way that easy foot entry into the ski boot is possible with high skiing comfort and high retaining force.

the straps/bands (holding elements) may also consist of one or more parts, be narrowly/broadly woven, e.g. be formed as hook or Velcro tapes, woven, knitted, knitted or made of spacer fabric, or knitted, as foil, as nonwoven, as composite material or scrim, or combined with foams, velour, spacer fabric, polyurethane, gel, but can also be connected with other materials such as steel cables, steel cords, synthetic cords, tapes, hook tapes, Velcro tapes.

the straps/bands (holding elements) to lock the feet in the ski boot, to keep the heel in position, to generate the pressure on the sole and on the shaft, as well as to generate the pressure on the ski, can be selected according to the comfort and anatomy in number and design, width, thickness, type of fabric, fabric hardness, fabric softness and padding, elasticity, lack of stretch. So according to the design, they can be used based on the desired comfort and foot anatomy. The customization is possible for sensitive feet, wide feet, narrow feet, feet with high instep, pronounced bones, different length/size, different anatomy.

the woven fabrics, knitted fabrics, scrims, composites, nonwovens, or films can be made of different yarns or blended yarns, but can also be blended or laminated from materials such as polyamide, polyester, polypropylene, polyurethane, spandex, PET, aramid, UHMWPE, LCP, carbon, wool, cotton, linen, viscose, silk, aluminum, titanium, steel, or can also have threads inserted for heat generation.

the upper structure made of materials such as leather, synthetic leather, nonwoven, synthetic fabric, knitted fabrics, foils, natural fiber fabrics, fabric composite, blended fabrics, laminates, membranes, ePTFE membranes/laminates/fabrics, 3-D fabrics, spacer fabrics, velour, extruded, molded or injected parts made of PET, PES, polypropylene, polyurethane, polyamide, UHMWPE, polyethylene, carbon, plastics of all mixtures and types, but also can be made of aluminum, titanium, steel, carbon or can have threads inserted for heat generation. The upper structure can be provided for closing with zipper, Velcro and hook straps, adhesive material, laces, buckles, snap fasteners.

the shaft may include materials such as extruded, molded or injection-molded parts made of PET, PES, polypropylene, polyurethane, polyamide, UHMWPE, polyethylene, carbon, modified plastics, plastics of all mixtures and types, but also aluminum, titanium, steel; the padding may include materials such as woven fabric, filled foam fabric, foam, gel, air cushion, spacer fabric or knitted fabric or materials in the 10-50 Shore range or may be enclosed with materials such as leather, synthetic leather, non-woven fabric, synthetic fabric, interlaced yarns, knitted fabric, films, natural fiber fabric, woven fabric composite, blended fabric, laminates, membranes, ePTFE membranes/laminates/fabrics, 3-D fabric, spacer fabric, velour, or the materials may also have threads inserted for heat generation.

Particularly noteworthy are the enormous advantages for special foot anatomy, different dimensions of left and right feet, feet with high ridges, a special bone anatomy, wide feet, narrow feet, long feet, short feet, anatomy differences of left and right feet, as well as differences in the lower part of the legs in sizes, widths, as well as anatomy and muscle formation, since, depending on the needs of the individual foot and leg anatomy, the bands can be varied in number and width, arranged and tensioned.

The wearing comfort, the desired hold in the ski boot, the hold of the heel, the hold over the instep, the hold in the shaft and the pressure on the ski, can thus be increased enormously in general for both feet and also individually for each foot.

Straps (traction element) for tension and pressure generation from the shaft to the shoe sole or binding area, binding plate or ski are preferably different from the straps for locking the feet (holding elements) and are preferably very low stretch.

The tension of the individual straps and foils which is adjusted according to the anatomy of the foot, positioning, riding comfort and skill to achieve the pressure on the feet and lower leg, is achieved by means of mechanical parts, such as buckles, hand wheels, wheels, shafts, drum wheels, flexible shafts, tensioning wheels, turnbuckles, cords, ropes.

For increased comfort, it is possible to add electromechanical elements, batteries, micromotors and their electronic control.

The respective strap tension and thus the pressure on the foot and lower leg can be applied by hand, by means of mechanical parts, such as hand wheels, rotating wheels, tensioning wheels, flexible shafts, ropes, cords, drum wheels, or buckles.

A particularly convenient solution of the tension of the individual belts is offered by an additional electromechanical solution with batteries, micromotors and their electronic control. The battery elements fixed in/on the ski boot, ski pole or in the ski jacket pocket, in a belt pocket serve to drive the micromotors, but can also be used to heat special upper boot materials, straps or the sole.

The control can be attached to the ski boot, through a mobile phone app or a control in the ski pole or in the ski jacket pocket or in a belt pocket also by Bluetooth transmission.

The shaft, which can be adjusted at an angle to the sole and is resistant to bending, can generate pressure on the ski boot sole, the binding, the binding plate and also additionally the ski by tilting forward, or also additionally by correspondingly, arranged bands (traction element). The one to several bands are attached to the shaft and the sole.

A flexurally rigid, but movable to the sole, padded shaft generates a variable, different pressure on the sole, or the binding plate, or the ski, by a forward leg pressure. The pressure is generated by a bending of the knee, thereby a forward bending movement of the leg, and thereby a pressure on the shaft, forward and therefore through the bands attached to the rear part of the shaft, which lead to the sole of the ski boot.

Several, but at least one band, in one or more parts, can be used.

The band tension (traction element) from the shaft to the sole, the binding area or the ski, can also be increased by additional mechanical and supplementary electromechanical elements.

Another design to keep the pressure constant is that a locking of the shaft, variable in an angle to the sole, according to the comfort and style of riding and a change in leg bending position, gives a more constant pressure through the strap attached to the shaft to the sole, binding plate or ski.

In particular, the upper structure should be made of a waterproof, windproof, hard or soft, insulating, warming, cut-resistant material. The materials can be freely chosen according to functionality and aesthetics, as they do not serve to generate pressure or to adapt to the anatomy of the foot. A multi-layered shoe upper is possible, which also consists, among other things, of materials that transport moisture away from the foot to the outside, an insulating layer, a warming fabric and an outer layer that serves for aesthetics. For additional foot warmth can also be introduced heat-forming elements or fabrics in the upper or the sole or the bands, heatable by means of electromechanical parts, such as a battery.

The upper of the shoe can be equipped for closing with zipper, Velcro and hook straps, light adhesive material, laces, buckles, snaps.

Another additional comfort or pressure distribution enhancing solution is an insole, which can be very comfort oriented or soft, but can also achieve a performance enhancing optimal pressure distribution from the foot to the sole, similar to a modern running shoe.

An ankle bandage or similar sock structure, e.g. made of an elastic, partially elastic, stiff, nonslip, moisture-wicking, warming and/or partially padded material, can be located for increased wearing comfort, easier ski boot entry, improved retention positioning in the boot, around the foot and under the straps (retention elements). This sock structure can be woven, knitted, interlaced yarns and can also be provided with warming fabric inserts or can also have inserted heating materials or gel/heating pads for warming the feet.

There is no actual shoe tongue, so that the step-in comfort can be significantly increased, even with a high instep.

While preferred embodiments of the invention are described in the present application, it should be clearly noted that the invention is not limited to these and may be carried out in other ways as well within the scope of the following claims.

The invention claimed is:

1. A ski boot (1) comprising a base frame (2) for holding a skier's foot, a rigid sole (3) connected to the base frame (2), a shaft (4) for receiving a lower leg part of the skier, the shaft (4) being connected to the base frame (2) in an angle-variable manner, a traction element (12) which is fastened in a toe region to the sole (3) and/or in a toe region of the base frame (2), runs from there to a heel region of the sole (3), is deflected in the heel region towards the shaft (4) and is fastened to the shaft (4), wherein the traction element (12) is guided in such a way that an inclination of the shaft (4) towards the toe region tensions the traction element (12) and leads to a traction on the sole (3) and/or the toe region of the base frame (2), wherein the traction element (12) is deflected a further time in the toe region of the sole (3), wherein the traction element (12) during the deflection and/or the further deflection runs around a bend of a channel in which the traction element (12) is guided, wherein the shaft (4) is connected to the base frame (2) via a joint, wherein the joint is located on a toe side at least 2 cm in front of the ankle area of the ski boot, and wherein the ski boot additionally comprises at least one holding element (6), the ends of which are attached to the base frame (2) and/or to the shaft (4) and which is adapted to hold the base frame (2) or the shaft (4) on the skier's foot, wherein the at least one holding element (6) comprises at least one of the following:

a mechanical adjustment element (5) and/or an electromechanical adjustment element (7), which is variable in its length in order to hold the base frame (2) or the shaft (4) on the foot of the skier in a non-slip manner, a forefoot a forefoot strap attached to the base frame (2) in a forefoot region of the ski boot, an ankle strap attached to the base frame (2) in an ankle region of the ski boot, and/or a lower leg strap attached to the shaft (4) in a lower leg region of the ski boot.

2. The ski boot according to claim 1, wherein the traction element (12) is fastened to the shaft (4) in a region remote from the sole.

3. The ski boot according to claim 1, wherein the traction element (12) is partially guided in a channel in the sole (3) or between the sole (3) and the base frame (2).

4. The ski boot according to claim 1, wherein the traction element (12) is fastened in a part of the sole (3) remote from the ground.

5. The ski boot according to claim 1, wherein a roller is rotatably mounted in the bend, over which the traction element is guided.

6. The ski boot according to claim 1, further comprising a locking device (29) for locking the shaft (4) at a definable angle to the base frame (2).

7. The ski boot according to claim 1, wherein the traction element (12) comprises one or more tapes.

8. The ski boot according to claim 1, wherein the traction element (12) comprises a mechanical tension element (28) and/or an electromechanical tension element (20) configured to adjust a length and/or a tension of the tension element (12).

9. The ski boot according to claim 8, wherein the mechanical tension element and/or the electromechanical tension element are designed to loosen or release the traction element (12) for a walking mode of the ski boot.

10. The ski boot according to claim 1, wherein the shaft (4) comprises a rigid element on the heel side to which the traction element (12) is attached.

11. The ski boot according to claim 10, wherein the rigid element is a hollow element through which the traction element (12) is passed.

12. The ski boot according to claim 1, wherein the sole (3) comprises a polyamide, modified plastic and/or a polyethylene.

13. The ski boot according to claim 1, wherein the base frame (2) comprises a polypropylene foam (EPP).

14. The ski boot according to claim 1, wherein the base frame (2), the sole (3) and/or the shaft (4) comprises one or more selected from the group consisting of the following materials:

plastic,
carbon,
polyamide,
polyester,
polypropylene,
polyurethane,
spandex,
polyethylene terephthalate (PET),
aramid,
ultra high molecular weight polyethylene (UHMWPE),
aluminum,
titanium, and
steel.

15. The ski boot according to claim 1, additionally comprising an upper structure (13) which can be inserted into the base frame (2) and the shaft (4) and, in the intended use, rests against the skier's foot.

16. The ski boot according to claim 15, wherein the upper structure (13) comprises a fastener (23).

17. The ski boot according to claim 15, wherein the upper structure (13) has one or more of the following properties:

waterproof,
moisture transporting,
windproof,
flexible, or
warming.

18. The ski boot according to claim 15, wherein the upper structure (13) additionally comprises a heating element (27).

19. The ski boot according to claim 1, additionally comprising an ankle bandage (8) which, in the intended use, encloses the skier's ankle and is insertable into the shaft (4) and the base frame (2).

20. The ski boot according to claim 19, wherein the ankle bandage (8) is held in the intended use by the at least one holding element (6).

21. The ski boot according to claim 19, wherein the ankle bandage (8) comprises a padded material.

22. The ski boot according to claim 1, additionally comprising a controller with a radio receiver which is set up to receive a radio signal from an external transmitter, wherein the controller is arranged to control the tension or length of one or more of the following:

the traction element (12),
the locking device (29),
the electromechanical tension element (20),
the at least one band (6), or
the electromechanical adjustment element (7).

23. The ski boot according to claim 1, further comprising a toothing (31*a*) on the traction element (12), which is accessible from an outer side of the sole (3).

24. A ski (36) for use with the ski boot of claim 23, comprising a ski traction element (30) extending from a binding region of the ski within the ski into a ski front portion (37) and/or into a ski rear portion (38) and being fixed in the ski front portion (37) and in the ski rear portion (38), respectively, wherein the ski traction element (30) comprises a ski toothing (31*b*) accessible from the outside in the binding area and adapted to be engaged with the toothing (31*a*) of the ski boot.

25. The ski according to claim 24, wherein the ski traction element runs in a part of the ski close to the ground.

26. The ski according to claim 24, wherein the ski traction element (30) is fixed to the ski front portion (37), and/or wherein the ski traction element (30), in the intended use with the ski boot (1), causes a pull on the ski front portion (37) when the shaft (4) is inclined towards the toe region.

27. The ski according to claim 24, further comprising a deflection (32) for the ski traction element (30) in the ski, wherein the ski traction element (30) is guided over the deflection (32) and fixed in the ski rear portion (38), and/or wherein the ski traction element (30), in the intended use with the ski boot (1), causes a pull on the ski rear portion (38) when the shaft (4) is inclined towards the toe region.

28. A system comprising the ski boot according to claim 23, a ski for use with the ski boot, said ski comprising traction element (30) extending from a binding region of the ski within the ski into a ski front portion (37) and/or into a ski rear portion (38) and being fixed in the ski front portion (37) and in the ski rear portion (38), respectively, wherein the ski traction element (30) comprises a ski toothing (31*b*) accessible from the outside in the binding area and adapted to be engaged with the toothing (31*a*) of the ski boot, and a ski binding attached to the ski and designed to hold the ski boot in the intended use.

29. A ski boot (1) comprising a base frame (2) for holding a skier's foot, a rigid sole (3) connected to the base frame (2), a shaft (4) for receiving a lower leg part of the skier, the shaft (4) being connected to the base frame (2) in an angle-variable manner, a traction element (12) which is fastened in a toe region to the sole (3) and/or in a toe region of the base frame (2), runs from there to a heel region of the sole (3), is deflected in the heel region towards the shaft (4) and is fastened to the shaft (4), wherein the traction element (12) is guided in such a way that an inclination of the shaft (4) towards the toe region tensions the traction element (12) and leads to a traction on the sole (3) and/or the toe region of the base frame (2), wherein the traction element (12) is deflected a further time in the toe region of the sole (3), wherein the traction element (12) during the deflection and/or the further deflection runs around a bend of a channel in which the traction element (12) is guided, wherein the shaft (4) is connected to the base frame (2) via a joint, wherein the joint is located on a toe side at least 2 cm in front of the ankle area of the ski boot, and wherein the ski boot additionally comprises a controller with a radio receiver which is set up to receive a radio signal from an external transmitter, wherein the controller is arranged to control the tension or length of the traction element (12).

* * * * *